US011828564B2

(12) United States Patent
Moriyasu et al.

(10) Patent No.: US 11,828,564 B2
(45) Date of Patent: Nov. 28, 2023

(54) BOW

(71) Applicant: Ternarc Inc., Okayama (JP)

(72) Inventors: Hiroki Moriyasu, Okayama (JP); Tomokazu Oko, Okayama (JP)

(73) Assignee: Ternarc Inc., Okayama (JP)

( * ) Notice: Subject to any disclaimer, the term of this patent is extended or adjusted under 35 U.S.C. 154(b) by 29 days.

(21) Appl. No.: 17/744,752

(22) Filed: May 16, 2022

(65) Prior Publication Data

US 2023/0304767 A1 Sep. 28, 2023

(30) Foreign Application Priority Data

Mar. 22, 2022 (JP) ..... 2022-045732

(51) Int. Cl.
*F41B 5/10* (2006.01)
*F41B 5/14* (2006.01)

(52) U.S. Cl.
CPC ..... *F41B 5/105* (2013.01)

(58) Field of Classification Search
CPC .. F41B 5/00; F41B 5/0094; F41B 5/10; F41B 5/105
USPC ..... 124/23.1, 25.6, 900, 86
See application file for complete search history.

(56) References Cited

U.S. PATENT DOCUMENTS 3,854,467 A * 12/1974 Hofmeister ..... F41B 5/105 124/90
3,923,035 A * 12/1975 Trotter ..... F41B 5/105 124/86
3,967,609 A * 7/1976 Frydenlund ..... F41B 5/105 124/90
3,987,777 A * 10/1976 Darlington ..... F41B 5/105 124/86
4,461,267 A * 7/1984 Simonds ..... F41B 5/105 124/900
4,817,580 A * 4/1989 Butterfield ..... F41B 5/10 124/25.6
4,903,677 A * 2/1990 Colley ..... F41B 5/105 124/23.1
5,054,463 A * 10/1991 Colley ..... F41B 5/10 124/900
5,503,135 A * 4/1996 Bunk ..... F41B 5/10 124/16

(Continued)

FOREIGN PATENT DOCUMENTS

JP 6666536 B 3/2020

*Primary Examiner* — Alexander R Niconovich
(74) *Attorney, Agent, or Firm* — Yokoi & Co., U.S.A.; Toshiyuki Yokoi

(57) ABSTRACT

A bow including: a frame having a predetermined length; a first pulley and a second pulley arranged on a first position and second position of the frame respectively; a first small diameter cam and a first large diameter cam rotated interlocked with the first pulley; a second small diameter cam and a second large diameter cam rotated interlocked with the second pulley; a string fixed to the first pulley and the second pulley, the first pulley and the second pulley being rotated when the string is pulled; a first cable and a second cable arranged in a linear shape between the first (second) small diameter cam and the second (first) large diameter cam, the first cable and the second cable being elastically deformed by being wound around the second large diameter cam or the first large diameter cam when the string is pulled.

10 Claims, 12 Drawing Sheets

(56) References Cited

U.S. PATENT DOCUMENTS 6,247,466 B1 * 6/2001 McPherson ..... F41B 5/10 124/900
6,698,413 B1 * 3/2004 Ecklund ..... F41B 5/105 124/23.1
7,047,958 B1 * 5/2006 Colley ..... F41B 5/10 124/25.6
7,578,289 B2 * 8/2009 Norkus ..... F41B 5/10 124/44.5
7,770,568 B1 * 8/2010 Yehle ..... F41B 5/105 124/25.6
7,891,348 B2 * 2/2011 Colley ..... F41B 5/105 124/25
8,387,604 B1 * 3/2013 Terzo ..... F41B 5/123 124/25
8,522,762 B2 * 9/2013 Trpkovski ..... F41B 5/1453 124/900
8,789,519 B2 * 7/2014 Nebergall ..... F41B 5/10 124/25.6
8,833,349 B2 * 9/2014 Park ..... F41B 5/0094 124/25.6
8,881,714 B1 * 11/2014 Cooper ..... F41B 5/105 124/90
9,417,028 B2 * 8/2016 Hyde ..... F41B 5/10
9,423,202 B1 * 8/2016 Obteshka ..... F41B 5/105
9,810,503 B2 * 11/2017 Serviss ..... F41B 5/1426
10,267,589 B1 * 4/2019 Snook ..... F41B 5/0094
10,746,496 B2 * 8/2020 Nishihira ..... F41B 5/105
11,156,428 B1 * 10/2021 Nishihira ..... F41B 5/105
11,255,627 B1 * 2/2022 Nishihira ..... F41B 5/105
2007/0101980 A1 * 5/2007 Sims ..... F41B 5/10 124/25.6
2022/0018626 A1 * 1/2022 Nishihira ..... F41B 5/105
2022/0221244 A1 * 7/2022 Moretti ..... F41B 5/1411

* cited by examiner

BOW

CROSS-REFERENCES TO RELATED APPLICATIONS

This patent specification is based on Japanese patent application, No. 2022-45732 filed on Mar. 22, 2022 in the Japan Patent Office, the entire contents of which are incorporated by reference herein.

BACKGROUND OF THE INVENTION

1. Field of the Invention

The present invention relates to a bow for shooting an arrow without using an elastic force of limbs.

2. Description of Related Art

In the conventional compound bows and recurved bows, the limbs are deformed (bent) to accumulate the elastic force in the limbs and the arrow is shot by using the elastic force of the limbs. A relatively large force is required for deforming the limbs and it is not easy to constantly accumulate the elastic force in the limbs.

For example, in order to solve the above described problem, Patent Document 1 discloses the technology of a bow where a cable fixed to both ends of a bow body is elastically deformed instead of elastically deforming the limbs. Thus, the elastic force is accumulated in the cable and the arrow is shot by the elastic force accumulated in the cable.

[Patent Document 1] Japanese Patent No. 6666536

BRIEF SUMMARY OF THE INVENTION

In the bow disclosed in Patent Document 1, the bow body is obliquely inclined rearward from the center to the upper and lower ends and a cable in which an elastic force is accumulated and a string on which an arrow is nocked are fixed to the upper and lower ends of the bow body. Namely, the bow body is formed in an arch shape (bow shape). In the bow configured as described above, since the entire length of the bow body is approximately same as the entire length of the bow, it is difficult to downsize the bow body. Therefore, problem is the inconvenience of storing and carrying the bow when the bow is not used. In addition, the shape of the bow body should be changed for changing the entire shape of the bow. Thus, it is not easy to finely adjust the shape of the bow according to the preference of a shooter.

The present invention provides a bow for shooting an arrow using an elastic force of a cable without using an elastic force of limbs having a structure capable of being compact when not in use enabling to facilitate storage and carriage while increasing flexibility of design and adjustment of an entire shape of the bow according to the preference of the shooter.

A bow of the present invention includes: a frame having a predetermined length; a first pulley arranged on a first position of the frame; a second pulley arranged on a second position of the frame; a first small diameter cam configured to be rotatable interlocked with the first pulley; a first large diameter cam configured to be rotatable interlocked with the first pulley; a second small diameter cam configured to be rotatable interlocked with the second pulley; a second large diameter cam configured to be rotatable interlocked with the second pulley; a string fixed to the first pulley and the second pulley, the first pulley and the second pulley being configured to be rotated when the string is pulled; a first cable arranged in a linear shape between the first small diameter cam and the second large diameter cam, the first cable being configured to be elastically deformed by being wound around the second large diameter cam when the string is pulled; and a second cable arranged in a linear shape between the second small diameter cam and the first large diameter cam, the second cable being configured to be elastically deformed by being wound around the first large diameter cam when the string is pulled.

In the bow configured as described above, the pulleys are rotated when the string is pulled. The small diameter cams and the large diameter cams are rotated interlocked with the pulleys. At this time, the cables arranged between the small diameter cams and the large diameter cams are wound around the large diameter cams. Since the outer diameter is different between the small diameter cams and the large diameter cams, the cables are elastically deformed in a tensile direction when the cables are wound around the large diameter cams. Thus, an elastic force is accumulated in the cables. Since the cables are arranged in a linear shape between the small diameter cams and the large diameter cams, the elastic force can be accumulated in a smaller mechanism compared to the case of using the bow body having an arch shape. In addition, since a portion of accumulating the elastic force is formed in a linear shape, the portion can be combined with members having various shapes. Namely, flexibility for designing an entire shape of the bow can be increased.

In the above described configuration, the first pulley and the second pulley can be configured to be movable along a direction connecting the first position and the second position so that a distance between the first position and the second position is expanded and contracted. In addition, the first pulley and the second pulley can be configured to be fixable to the frame at an arbitrary position in a moving area of the first pulley and the second pulley with respect to the frame.

In the bow configured as described above, since the distance between the pulleys can be expanded and contracted, the tension of the string and the cable can be adjusted. In addition, the deterioration of the string and the cable can be prevented by loosening the tension of the string and the cable when not in use.

In the above described configuration, the bow can further include: a first arm fixed to the frame; a second arm fixed to the frame; a third pulley arranged on the first arm; and a fourth pulley arranged on the second arm, wherein the string is wound around the third pulley and the fourth pulley.

In the bow configured as described above, since the frame, the first arm and the second arm are combined, the entire shape of the bow can be easily specified. In addition, since the string is wound around the third pulley and the fourth pulley, the entire shape of the bow can be easily modified so that the shooter can easily pull the bow.

In the above described configuration, the first arm can be configured to be attachable to and detachable from the frame, and the second arm can be configured to be attachable to and detachable from the frame. In the bow configured as described above, the entire shape of the bow can be easily changed only by replacing the first arm and the second arm. In addition, the bow can be downsized by detaching the first arm and the second arm from the frame when storing and carrying the bow.

In the above described configuration, the bow can further include a grip attachable to and detachable from the frame.

In the bow configured as described above, in addition to the combination of the frame, the first arm and the second arm, the entire shape of the bow can be variously modified by further combining the grip.

In the above described configuration, a first inclination angle of the first arm can be configured to be changeable with respect to a line connecting the first position and the second position of the frame, and a second inclination angle of the second arm can be configured to be s changeable with respect to the line connecting the first position and the second position of the frame.

In the bow configured as described above, the positions of the third pulley and the fourth pulley can be changed with respect to the frame in the front-rear direction by changing the inclination angles of the first arm and the second arm with respect to the frame. Consequently, the draw length (length of drawing string) can be easily adjusted only by changing the inclination angles of the first arm and the second arm.

In the above described configuration, the first arm can be configured to be foldable around a first rotation shaft of the third pulley in a state that the first arm is detached from the frame, and the second arm can be configured to be foldable around a second rotation shaft of the fourth pulley in a state that the second arm is detached from the frame.

In the bow configured as described above, the bow can be stored and carried in a state that the bow is folded small when the first arm and the second arm are detached from the frame.

The present invention enables to provide a bow for shooting an arrow using an elastic force of a cable without using an elastic force of limbs having a structure capable of being compact when not in use enabling to facilitate storage and carriage while increasing flexibility of design and adjustment of an entire shape of the bow according to the preference of the shooter. Note that the energy can be efficiently converted since the weight of the portion of storing energy is small.

DETAILED DESCRIPTION OF THE INVENTION

Figure 1:
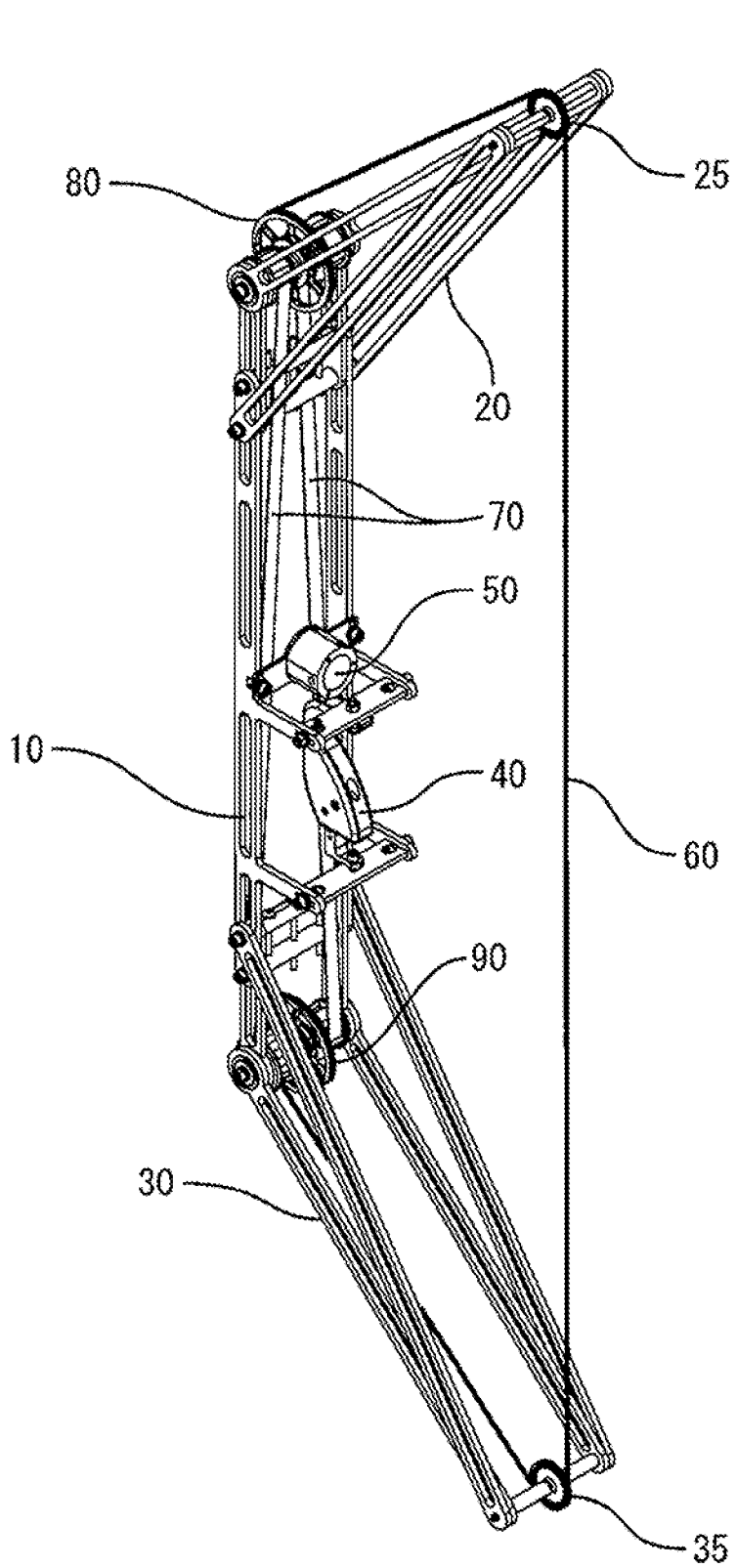
FIG. 1 is a perspective view of a bow concerning an embodiment of the present invention.

Hereafter, embodiments of the present invention will be explained referring to the drawings shown as an example.

FIG. 1 is a perspective view of a bow 1 concerning an embodiment of the present invention. The bow 1 is formed by a frame 10, a first arm 20, a second arm 30, a grip 40, a rest 50, a string 60, a cable 70 and the like. An upper end of the string 60 is fixed to a first pulley 80 provided on the frame 10 and wound (tensed) around the first pulley 80. A lower end of the string 60 is fixed to a second pulley 90 provided on the frame 10 and wound around the second pulley 90. Furthermore, the string 60 is wound around a third pulley 25 provided on the first arm 20 and a fourth pulley 35 provided on the second arm 30. Note that the first pulley 80, the second pulley 90, the third pulley 25 and the fourth pulley 35 are arranged on the same plane. When the shooter fits (nocks) the arrow to the string 60 at an intermediate position between the third pulley 25 and the fourth pulley 35 and pulls (draws) the arrow rearward, the first pulley 80, the second pulley 90, the third pulley 25 and the fourth pulley 35 are turned (rotated) interlocked with each other. At this time, the string 60 wound around the first pulley 80 and the second pulley 90 is delivered rearward. Thus, the shooter can rotate the first pulley 80 and the second pulley 90 by pulling the string 60 rearward without requiring large force. As described later, the elastic force is accumulated in the cable 70 by the rotation of the first pulley 80 and the second pulley 90. Note that the explanation will be made in the specification in a condition that the shooting direction of the arrow is frontward and the pulling direction of the arrow is rearward. In addition, the pulley is a member around which the string is fixed or wound.

Figure 2:
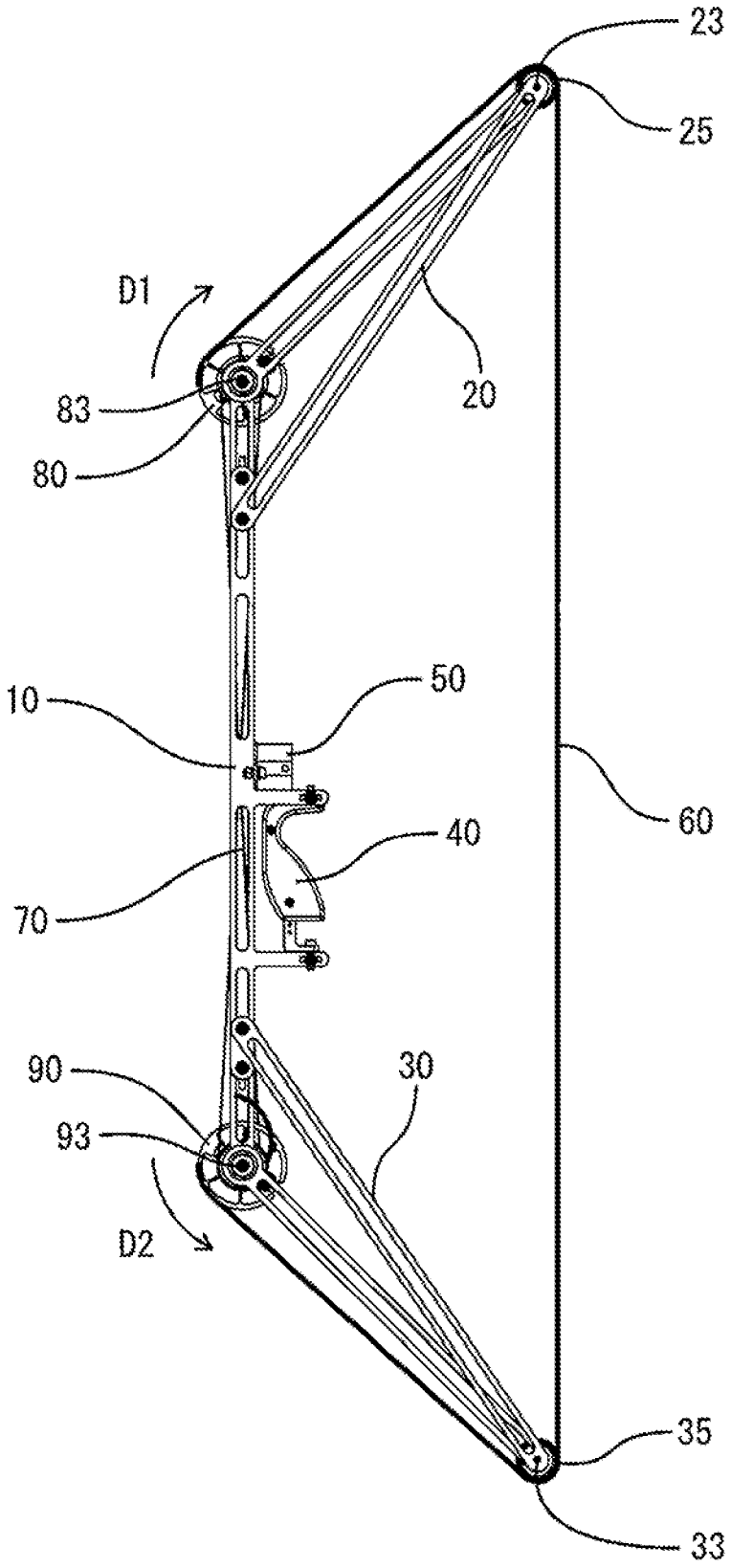
FIG. 2 is a left side view of the bow.
Figure 3:
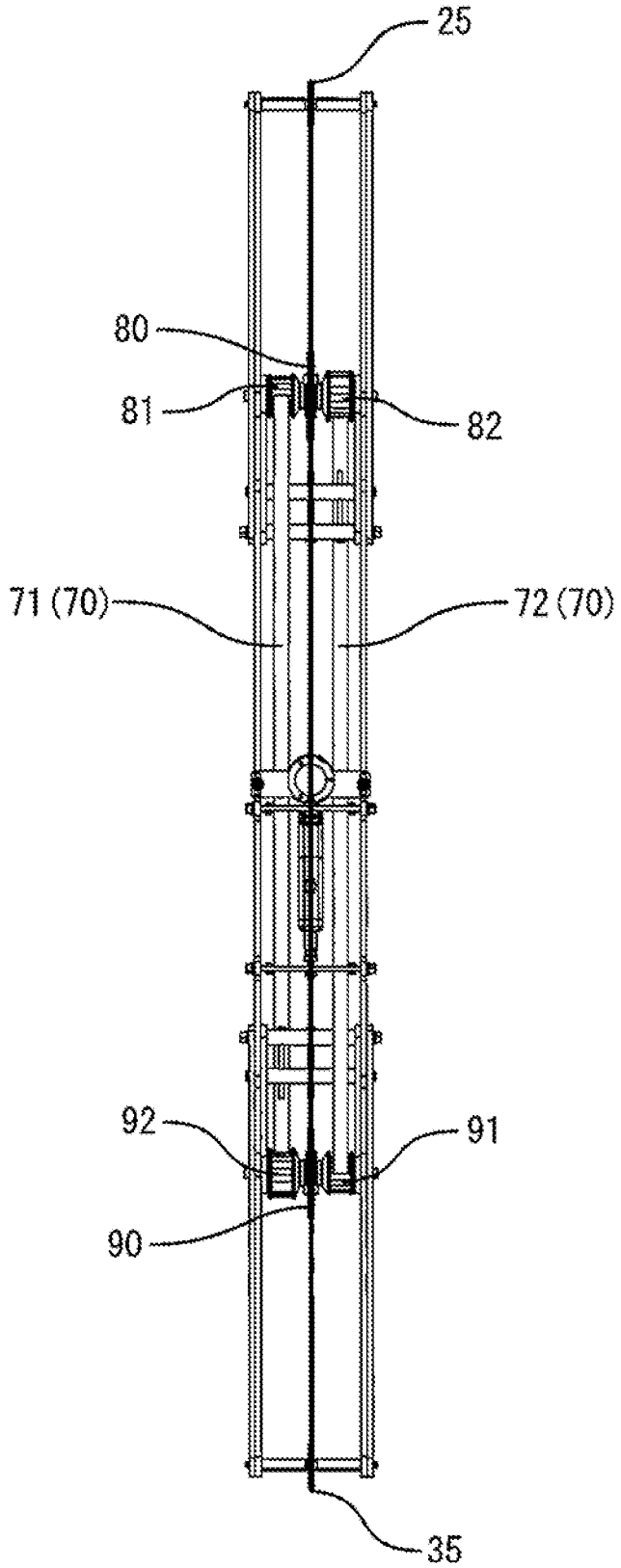
FIG. 3 is a rear view of the bow.

FIG. 2 is a left side view of the bow 1 and FIG. 3 is a rear view of the bow 1. As shown in FIG. 2 and FIG. 3, the first pulley 80 is arranged on the upper end portion (first position) of the frame 10 and the second pulley 90 is arranged on the lower end portion (second position) of the frame 10. In the first position, a first small diameter cam 81 is arranged at the left side and a first large diameter cam 82 is arranged at the right side sandwiching the first pulley 80 when viewed from the rear. The first pulley 80, the first small diameter cam 81 and the first large diameter cam 82 are inserted through (around) a first rotation shaft 83 in a state that they are fixed to each other. Thus, they are rotated interlocked with each other around the first rotation shaft 83 as a center. In the second position, a second large diameter cam 92 is arranged at the left side and a second small diameter cam 91 is arranged at the right side sandwiching the second pulley 90 when viewed from the rear. The second pulley 90, the second small diameter cam 91 and the second large diameter cam 92 are inserted around a second rotation shaft 93 in a state that they are fixed to each other. Thus, they are rotated interlocked with each other around the second rotation shaft 93 as a center. The second large diameter cam 92 is arranged below the first small diameter cam 81 on the same straight line. The second small diameter cam 91 is arranged below the first large diameter cam 82 on the same straight line. The outer diameter of the first large diameter cam 82 is larger than the outer diameter of the first small diameter cam 81. The outer diameter of the second large diameter cam 92 is larger than the outer diameter of the second small diameter cam 91. In addition, the outer diameter of the first small diameter cam 81 is equal to the outer diameter of the second small diameter cam 91. The outer diameter of the first large diameter cam 82 is equal to the outer diameter of the second large diameter cam 92. The third pulley 25 is inserted through (around) a third rotation shaft 23 and rotated around the third rotation shaft 23 as a center. The fourth pulley 35 is inserted through (around) a fourth rotation shaft 33 and rotated around the fourth rotation shaft 33 as a center.

Figure 4:
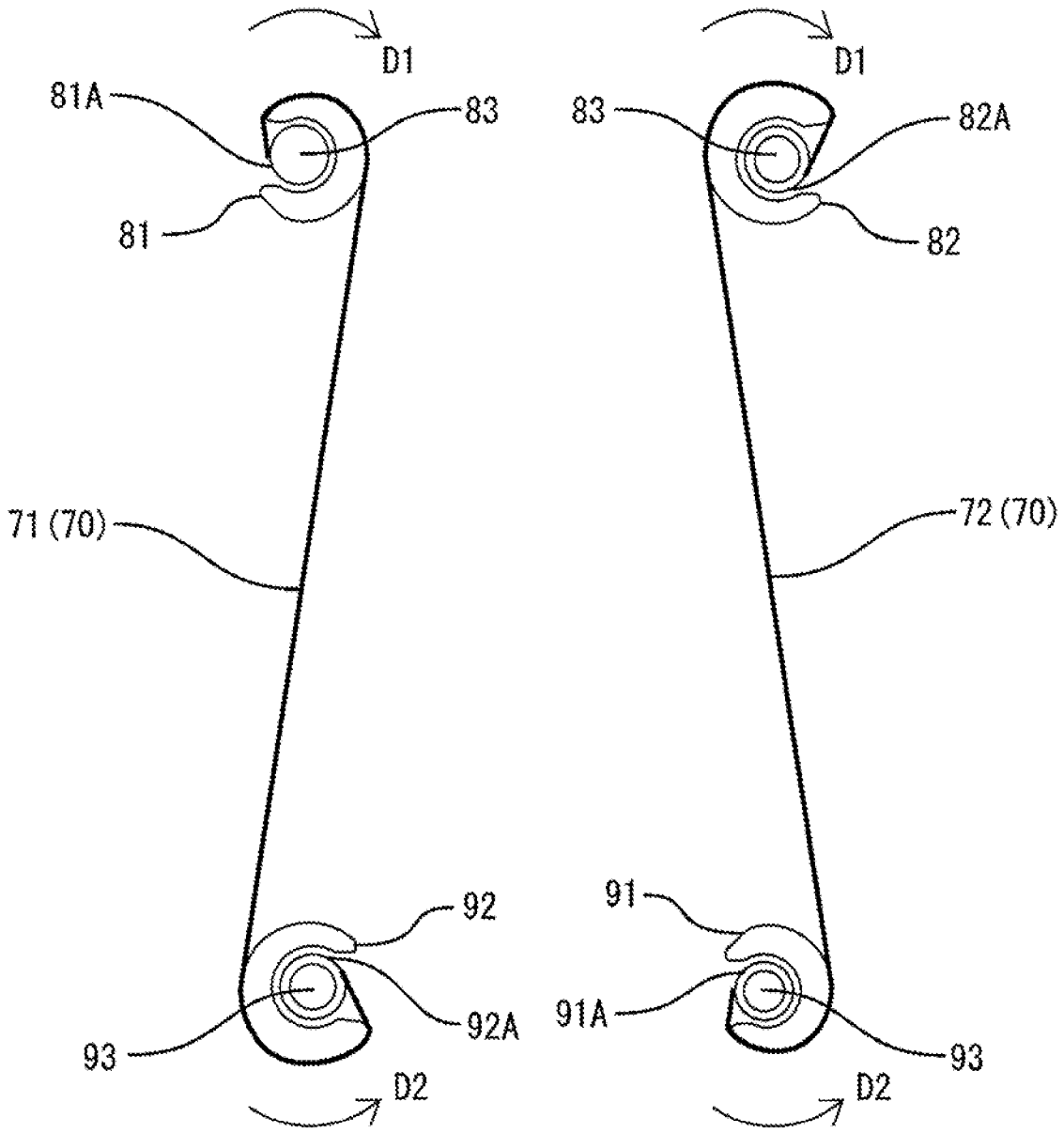
FIG. 4 is a drawing schematically showing an arrangement of the cable arranged on small diameter cams and large diameter cams.

FIG. 4 is a drawing schematically showing an arrangement of the cable 70 arranged on the first small diameter cam 81, the first large diameter cam 82, the second small diameter cam 91 and the second large diameter cam 92. The cable 70 is formed by a first cable 71 and a second cable 72 both formed of an elastic material capable of being elastically deformed (extended). FIG. 4 is a drawing of the cables 71, 72 viewed from the left side of the bow 1. The upper end portion of the cable 71 is fixed to a bobbin 81A and the lower end portion of the cable 71 is fixed to a bobbin 92A. The bobbin 81A is arranged on the inside of the first small diameter cam 81 and fixed to the first rotation shaft 83. The bobbin 92A is arranged on the inside of the second large diameter cam 92 and fixed to the second rotation shaft 93. The upper end portion of the cable 72 is fixed to a bobbin 82A and the lower end portion of the cable 72 is fixed to a bobbin 91A. The bobbin 82A is arranged on the inside of the first large diameter cam 82 and fixed to the first rotation shaft 83. The bobbin 91A is arranged on the inside of the second small diameter cam 91 and fixed to the second rotation shaft 93. By the configurations as described above, the first cable 71 is linearly arranged between the first small diameter cam 81 and the second large diameter cam 92 and the second cable 72 is linearly arranged between the first large diameter cam 82 and the second small diameter cam 91.

The first cable 71 and the second cable 72 are arranged to cross each other at the center of the vertical direction when viewed from the left side.

When the shooter pulls the string 60 rearward, the first pulley 80 is rotated around the first rotation shaft 83 in the first direction D1 (FIG. 2, FIG. 4) and the second pulley 90 is rotated around the second rotation shaft 93 in the second direction D2 (FIG. 2, FIG. 4). At this time, the first pulley 80 is interlockingly rotated with the first small diameter cam 81 in the first direction D1. Thus, the first cable 71 is delivered downward. Namely, the first pulley 80 is rotated in the direction of loosening the tension of the first cable 71. In addition, the second large diameter cam 92 is interlockingly rotated with the second pulley 90 in the second direction D2. Thus, the first cable 71 is wound around an outer periphery of the second large diameter cam 92. Namely, the second pulley 90 is rotated in the direction of strengthening the tension of the first cable 71. Since the outer diameter of the second large diameter cam 92 is larger than the outer diameter of the first small diameter cam 81, the length of winding the first cable 71 by the second large diameter cam 92 is longer than the length of delivering the first cable 71 from the first small diameter cam 81. Accordingly, the first cable 71 is elastically deformed in the tensile direction. The state of accumulating the elastic force in the first cable 71 is kept until the shooter shots the arrow. In addition, the first large diameter cam 82 is interlockingly rotated with the first pulley 80 in the first direction D1. Thus, the second cable 72 is wound around an outer periphery of the first large diameter cam 82. Namely, the first pulley 80 is rotated in the direction of strengthening the tension of the second cable 72. In addition, the second small diameter cam 91 is interlockingly rotated with the second pulley 90 in the second direction D2. Thus, the second cable 72 is delivered upward. Namely, the second pulley 90 is rotated in the direction of loosening the tension of the second cable 72. Since the outer diameter of the first large diameter cam 82 is larger than the outer diameter of the second small diameter cam 91, the length of winding the second cable 72 by the first large diameter cam 82 is longer than the length of delivering the second cable 72 from the second small diameter cam 91. Accordingly, the second cable 72 is elastically deformed in the tensile direction. The state of accumulating the elastic force in the second cable 72 is kept until the shooter shots the arrow. Note that each of the cams is formed in a flattened circular shape in a side view. Namely, each of the cams is formed so that the distance (radius) from the center is different depending on the position on an outer circumference of the cams. Consequently, the amount of delivering and wounding the cables varies depending on the rotation angle of the cams. In the present invention, an approximately cylindrical shaped member interlockingly rotated with the pulleys to deliver and wound the cable is referred to as a cam. The cam be also referred to as a reel in the sense that the cable is wound around the cam.

Since the above described configurations are adopted, the elastic force of the tensile direction is accumulated in the first cable 71 and the second cable 72 when the shooter pulls the bow. When the shooter releases the arrow, the first small diameter cam 81 and the first large diameter cam 82 located at the upper part of the frame 10 is rotated in a reverse direction of the first direction D1 and the second small diameter cam 91 and the second large diameter cam 92 located at the lower part of the frame 10 is rotated in a reverse direction of the second direction D2 by the restoring force for restoring the elastically deformed first cable 71 and second cable 72. The first pulley 80 interlockingly rotated with the first small diameter cam 81 and the first large diameter cam 82 is rotated in the direction of pulling the string 60 upward. The second pulley 90 interlockingly rotated with the second small diameter cam 91 and the second large diameter cam 92 rotated in the direction of pulling the string 60 downward. Consequently, the string 60 pulled rearward is pulled back to frontward and the arrow nocked on the string 60 is shot frontward.

The first cable 71 and the second cable 72 are made of polyarylate fiber, aramid fiber, poly para-phenylene benzobisoxazole fiber, carbon fiber or the like. Specifically, ZYLON (trademark) manufactured by TOYOBO CO., LTD., Vectran (trademark) manufactured by KURARAY Co., Ltd. and the like can be used. The first cable 71 and the second cable 72 are formed by fixing an end portion of the fiber on the bobbin 81A (82A) or the bobbin 92A (91A), winding the fiber between the bobbin 81A (82A) and the bobbin 92A (91A) a plurality of times, and fixing the other end portion of the fiber on the bobbin 81A (82A) or the bobbin 92A (91A). It is also possible to bundle the above described fiber in a band shape for obtaining necessary elastic force and strength. It is also possible to knit the fiber for increasing the strength. When necessary strength can be obtained by bundling or knitting the fiber, it is not necessary to wind the fiber between the bobbin 81A (82A) and the bobbin 92A (91A) a plurality of times. In such a case, it is enough to fix the end portions of the fiber on the bobbins. It is also possible to arrange the above described fiber on an inner side of a cylinder made of Teflon (trademark) so that the fiber is exposed outside the cylinder in a ring shape at both end portions of the cylinder. As for the method of forming a ring shape at the end portions of the fiber having a linear shape, the method of knotting an anchor rope of ship can be applied. When the end portions of the fiber are formed in a ring shape, the first cable 71 and the second cable 72 can be fixed to the bobbins (cams) only by inserting the ring shaped end portions around the outer periphery of the bobbins. Namely, the cable can be attached and detached easily.

Figure 5:
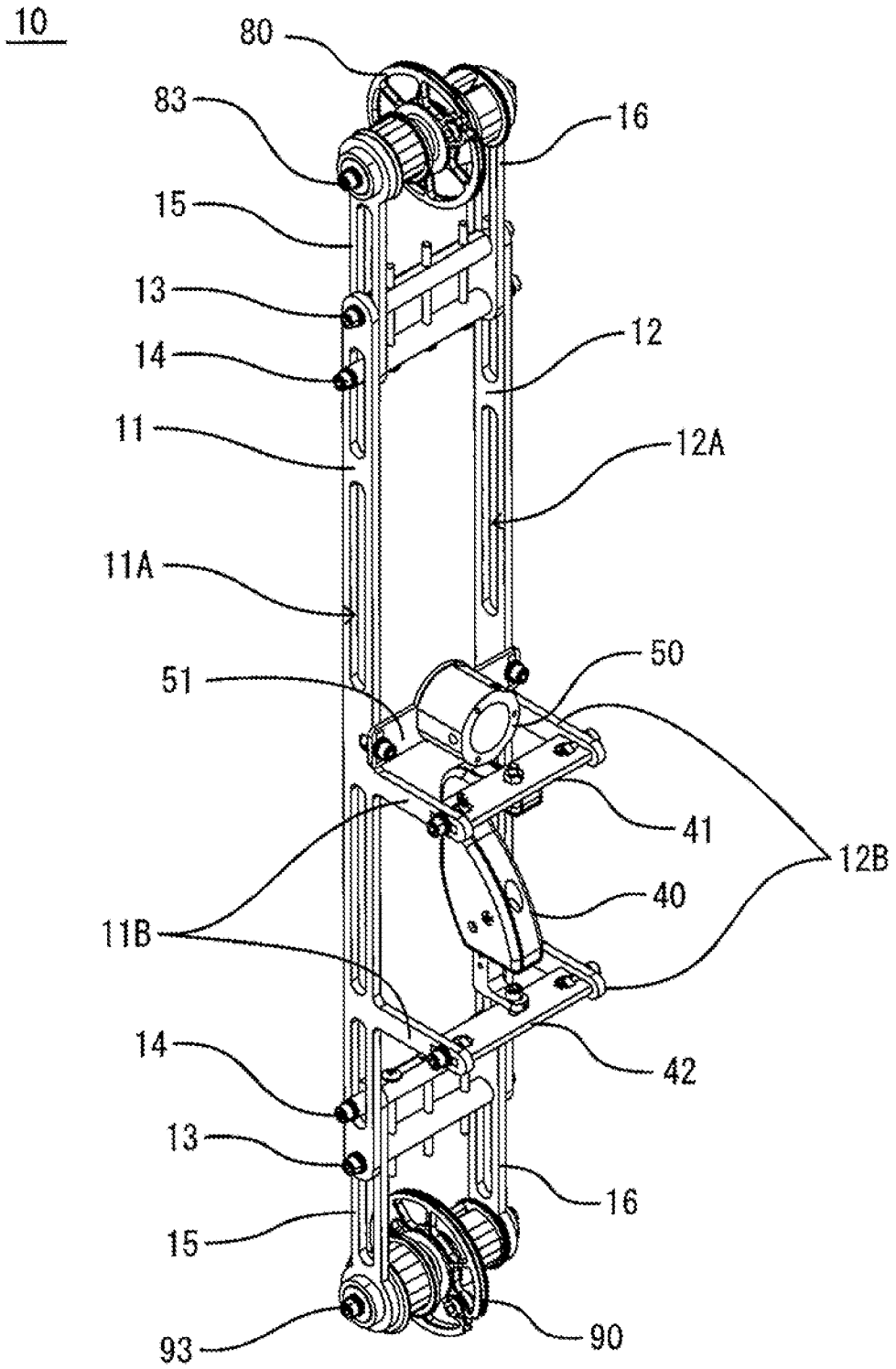
FIG. 5 is a perspective view of a frame to which a grip, a rest, a first pulley, a second pulley and the like are attached.

FIG. 5 is a perspective view of the frame 10 to which the grip 40, the rest 50, the first pulley 80, the second pulley 90 and the like are attached. The configurations of the frame 10 will be explained using FIG. 5. As shown in FIG. 5, the frame 10 is formed by a left plate 11, a right plate 12, a connection shaft 13, a movable shaft 14, a left movable plate 15, a right movable plate 16 and the like. The left plate 11 and the right plate 12 are plate members formed in a linear shape having a predetermined length to connect the first position with the second position. The left plate 11 and the right plate 12 have the same shape with each other. A plurality of notches 11A, 12A is formed on the left plate 11 and the right plate 12 so that the left plate 11 and the right plate 12 are bored at an intermediate portion through a plate thickness direction. The notches 11A, 12A have a predetermined length in a longitudinal direction of each plate. The end portions of the notches 11A, 12A are formed in a semicircular shape. The notches 11A, 12A can be used as a guide groove when the movable shaft 14 is moved in the vertical direction or used as a hole into which a bolt is inserted when accessories are fixed to the frame 10. The connection shaft 13 is a member formed in a cylindrical shape. When both ends (upper and lower ends) of the left plate 11 and the right plate 12 are fixed to two connection shaft 13, the left plate 11 and the right plate 12 are arranged to have a predetermined distance from each other in the left-right direction.

Two projections 11B, 12B extended rearward are formed on each of the left plate 11 and the right plate 12 so that the grip 40 is fixed to the projections 11B, 12B. The grip is a portion gripped by the shooter when the arrow is shot. Connection plates 41, 42 are fixed to the upper end and the lower end of the grip 40 for connecting the grip 40 with the frame 10. A bolt hole is formed on each of two projections 11B of the left plate 11 and two projections 12B of the right plate 12 for inserting bolts into the bolt holes for fixing the connection plates 41, 42. A recessed portion for arranging a nut is formed on each of the connection plates 41, 42. The grip 40 is detachably fixed to the frame 10 by fixing the bolt inserted into the projections 11B, 12B to the nut arranged on the recessed portion of the connection plates 41, 42. The rest 50 is a portion on which the arrow is placed and supported when the arrow is shot. A connection plate 51 is fixed on the front part of the rest 50 for connecting the rest 50 with the frame 10 and a bolt hole if formed on the connection plate 51. A recessed portion is formed on each of the left plate 11 and the right plate 12 for arranging a nut in the recessed portion to fix the rest 50 in the recessed portion. The rest 50 is detachably fixed to the frame 10 by fixing the bolts inserted into the connection plate 51 to the nut arranged in the recessed portion of the left plate 11 and the right plate 12.

Figure 6:
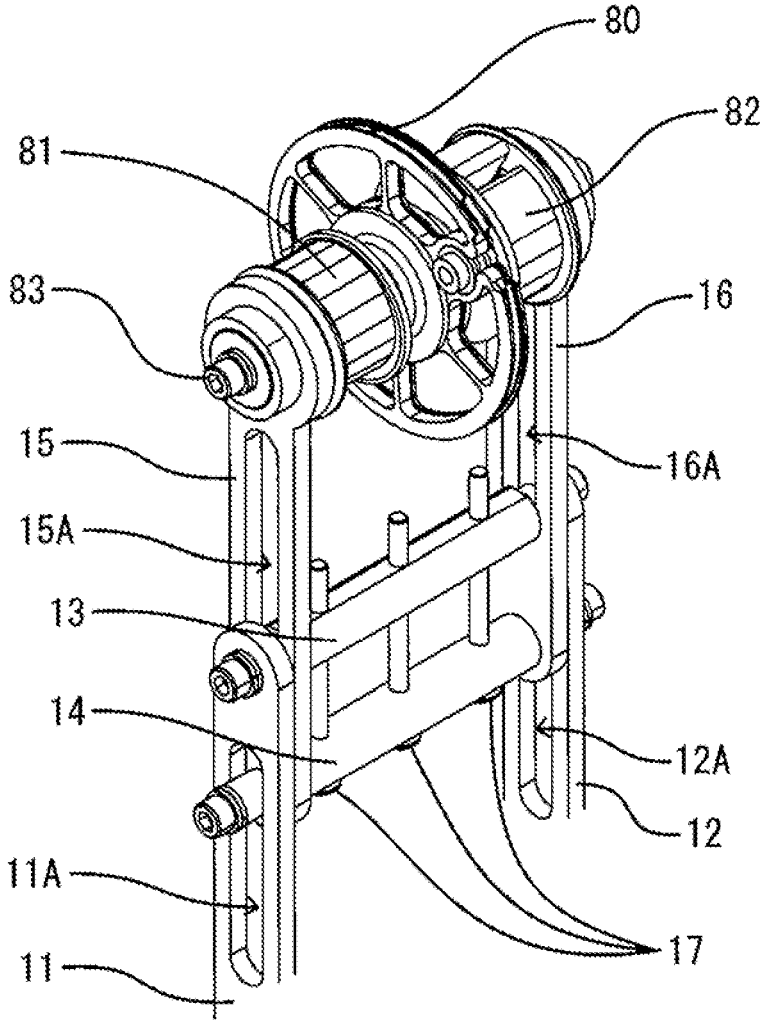
FIG. 6 is an enlarged perspective view of an upper part of the frame.

FIG. 6 is an enlarged perspective view of an upper part of the frame 10. The configuration of moving the first rotation shaft 83 in the vertical direction (direction connecting the first position and the second position) will be explained using FIG. 6. Note that the explanation of the configuration of moving the second rotation shaft 93 located at the lower part of the frame 10 in the vertical direction is omitted since the shape is same as FIG. 6 except for that the second rotation shaft 93 is arranged symmetrically with the first rotation shaft 83 in the vertical direction. The left movable plate 15 and the right movable plate 16 are plate members formed in a linear shape having a predetermined length. One end (upper end) of the left movable plate 15 and the right movable plate 16 is fixed to the first rotation shaft 83 and the other end (lower end) is fixed to the movable shaft 14 having a cylindrical shape. Consequently, the left movable plate 15 and the right movable plate 16 are arranged to have a predetermined distance from each other in the left-right direction. Note that the first pulley 80, the first small diameter cam 81 and the first large diameter cam 82 are inserted around an outer periphery of the first rotation shaft 83 so that they are integrally rotated around the first rotation shaft 83 as a center. The left movable plate 15 and the right movable plate 16 are arranged on an inside of the left plate 11 and the right plate 12. A plurality of notches 15A, 16A is formed on the left movable plate 15 and the right movable plate 16 so that the left movable plate 15 and the right movable plate 16 are bored at an intermediate portion through a plate thickness direction. The notches 15A, 16A have a predetermined length in a longitudinal direction of each plate. The end portions of the notches 15A, 16A are formed in a semicircular shape. The connection shaft 13 fixed to the upper end of the frame 10 is inserted into the notches 15A, 16A of the left movable plate 15 and the right movable plate 16. The movable shaft 14 is inserted into the notches 11A, 12A of the left plate 11 and the right plate 12. When the movable shaft 14 is slid along the notches 11A, 12A in the vertical direction, the left movable plate 15 and the right movable plate 16 fixed to the movable shaft 14 are moved in the vertical direction. Consequently, the first rotation shaft 83 fixed to the end portions of the left movable plate 15 and the right movable plate 16 can be moved in the vertical direction. Namely, the first pulley 80 inserted around the first rotation shaft 83 and the second pulley 90 inserted around the second rotation shaft 93 are configured to be movable in the longitudinal direction of the frame 10. A bolt 17 is inserted into the movable shaft 14 and inserted into the connection shaft 13. A screw thread formed on the bolt 17 is screwed with the connection shaft 13. Consequently, the position of the movable shaft 14 can be changed in the vertical direction with respect to the connection shaft 13 by rotating the bolt 17 and the movable shaft 14 can be fixed by the bolt 17.

As described above, the distance between the first pulley 80 (first position) and the second pulley 90 (second position) is expandable and contractible by moving the first rotation shaft 83 and the second rotation shaft 93 in the vertical direction. The first pulley 80 and the second pulley 90 are fixed to the frame 10 so that the positions of the first pulley 80 and the second pulley 90 are most suitable. Namely, the first pulley 80 and the second pulley 90 are configured to be fixable to the frame 10 at an arbitrary position (predetermined position) in a moving area of the first pulley 80 and the second pulley 90 with respect to the frame 10. Thus, the tension of the string and the cable can be adjusted. In addition, the tension of the string and the cable can be loosened when not in use. Thus, the deterioration of the string and the cable can be suppressed. Furthermore, the string and the cable can be easily attached and detached when replacing the string and the cable.

Figure 7:
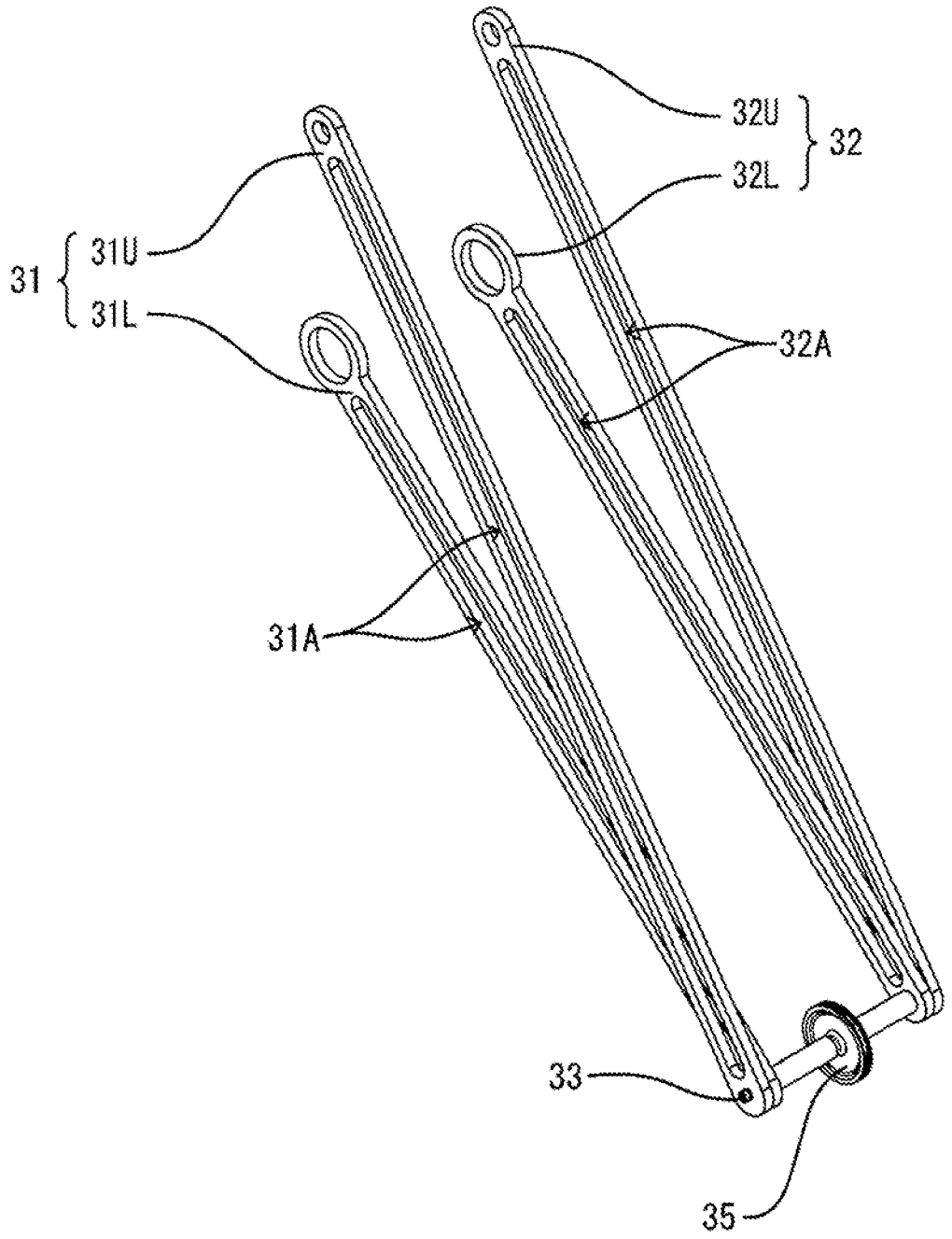
FIG. 7 is a perspective view of a second arm.

FIG. 7 is a perspective view of the second arm 30. Note that the explanation of the first arm 20 is omitted since the shape of the first arm 20 is same as the shape of the second arm 30 except for that the first arm 20 is arranged symmetrically with the second arm 30 in the vertical direction. As shown in FIG. 7, the second arm 30 is formed by a left plate 31, a right plate 32, a fourth rotation shaft 33 and a fourth pulley 35. The left plate 31 (right plate 32) is a plate member having a linear shape and formed by a lower plate 31L (32L) and an upper plate 31U (32U). Notches 31A, 32A are formed respectively on the left plate 31 and the right plate 32 so that the left plate 31 and the right plate 32 are bored at an intermediate portion through a plate thickness direction. The lower plate 31L (32L) and the upper plate 31U (32U) are fixed to the fourth rotation shaft 33 at one end portion and configured to be rotatable around the fourth rotation shaft 33 as a center. Namely, the relative angle between the lower plate 31L (32L) and the upper plate 31U (32U) can be changed. As shown in FIG. 2 and other figures, the other end portion of the lower plate 31L (32L) is inserted around the second rotation shaft 93 and fixed to the second rotation shaft 93 at the lower end of the frame 10. In addition, the other end of the upper plate 31U (32U) is inserted around the movable shaft 14 and fixed to the movable shaft 14. The movable shaft 14 is inserted into the notches 11A, 12A of the frame 10 at the upper part of the second rotation shaft 93. Thus, the movable shaft 14 is movable in the vertical direction.

Figure 8:
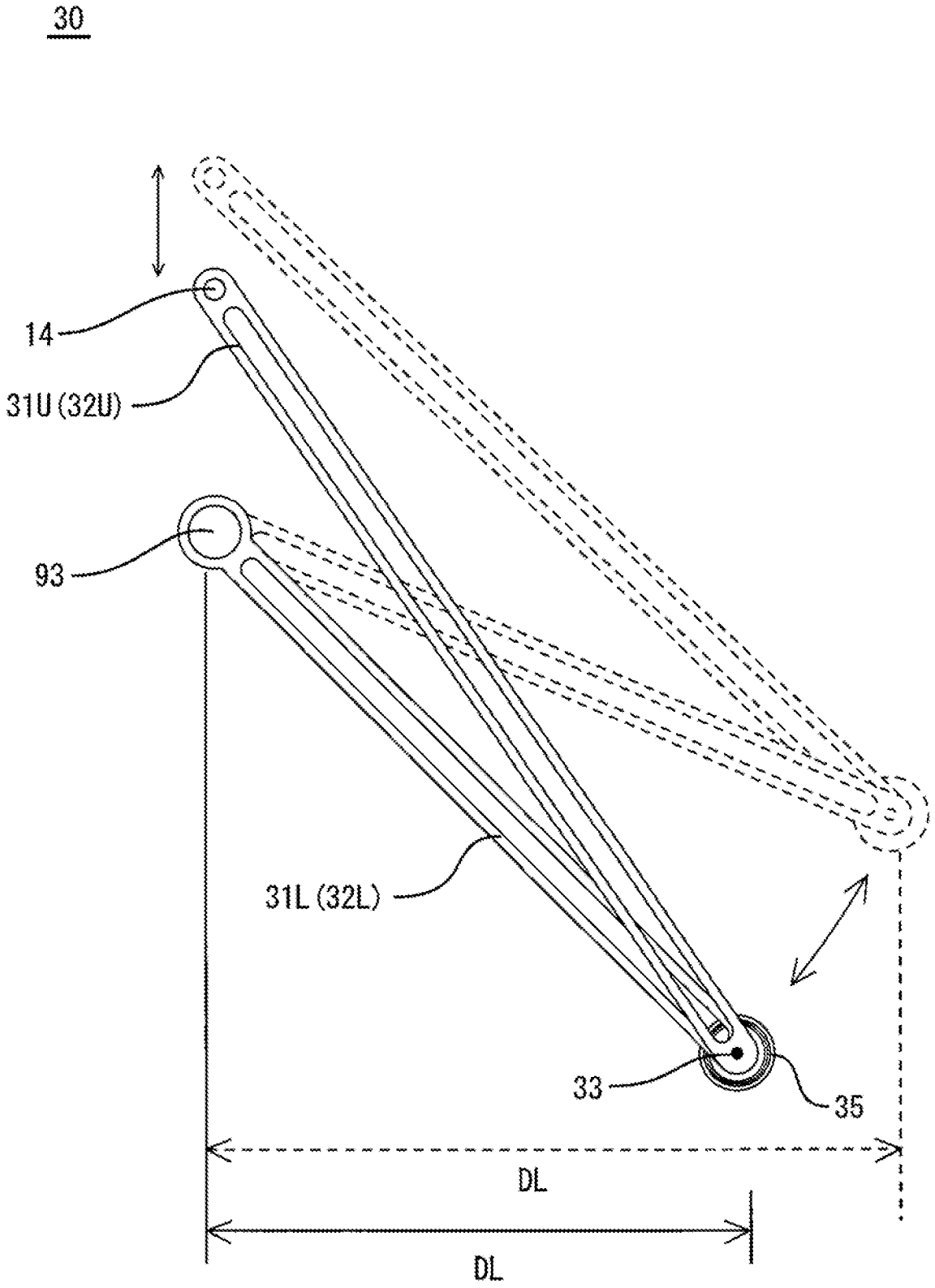
FIG. 8 is a left side view showing a movement of the second arm in a vertical direction.

FIG. 8 is a left side view showing a movement of the second arm 30 in the vertical direction. The movable shaft 14 is not fixed to the left movable plate 15 and the right movable plate 16 and the movable shaft 14 is movable along the notches 11A, 12A of the frame 10. Thus, the second arm 30 is configured to be movable in the vertical direction. As shown in FIG. 8, when the movable shaft 14 is moved along the vertical direction (direction connecting first position and second position) in a state that the second rotation shaft 93 is fixed to the frame 10, the upper plate 31U (32U) is slid upward and the lower plate 31L (32L) is rotated around the second rotation shaft 93. Consequently, the position of the fourth rotation shaft 33 is moved upward in an arc shape around the second rotation shaft 93 as a center. Namely, the inclination angle of the second arm 30 can be changed with respect to the line connecting the first position and the second position. Since the other end of the upper plate 31U (32U) is fixed to the movable shaft 14, the inclination angle of the second arm 30 can be changed so as to be interlocked with the vertical motion of the second rotation shaft 93. It is also possible that the upper plate 31U (32U) is fixed to the notches 11A, 12A of the frame 10 at the position different from the movable shaft 14. In such a case, the inclination angle of the second arm 30 can be changed independently from the vertical motion of the second rotation shaft 93.

As described above, the position of the third pulley 25 and the fourth pulley 35 can be changed with respect to the frame 10 in the vertical direction and the front-rear direction by changing the inclination angle of the second arm 30. When the position of the fourth rotation shaft 33 is changed with respect to the frame 10 in the front-rear direction, the draw length DL is changed. Namely, the draw length can be easily adjusted only by moving the movable shaft 14 in the vertical direction. In the second arm 30, the lower plate 31L (32L) and the upper plate 31U (32U) can be rotated with respect to each other around the fourth rotation shaft 33 as a rotation shaft. Namely, the relative angle between the lower plate 31L (32L) and the upper plate 31U (32U) can be changed. Consequently, the second arm 30 is foldable around the fourth rotation shaft 33 (rotation shaft of fourth pulley 35) in a state that the second arm 30 is detached from the frame 10. Accordingly, the second arm 30 can be carried and stored in a state that the second arm is folded small. Note that the first arm 20 can be configured to be movable in the vertical direction same as the second arm 30.

Figure 9:
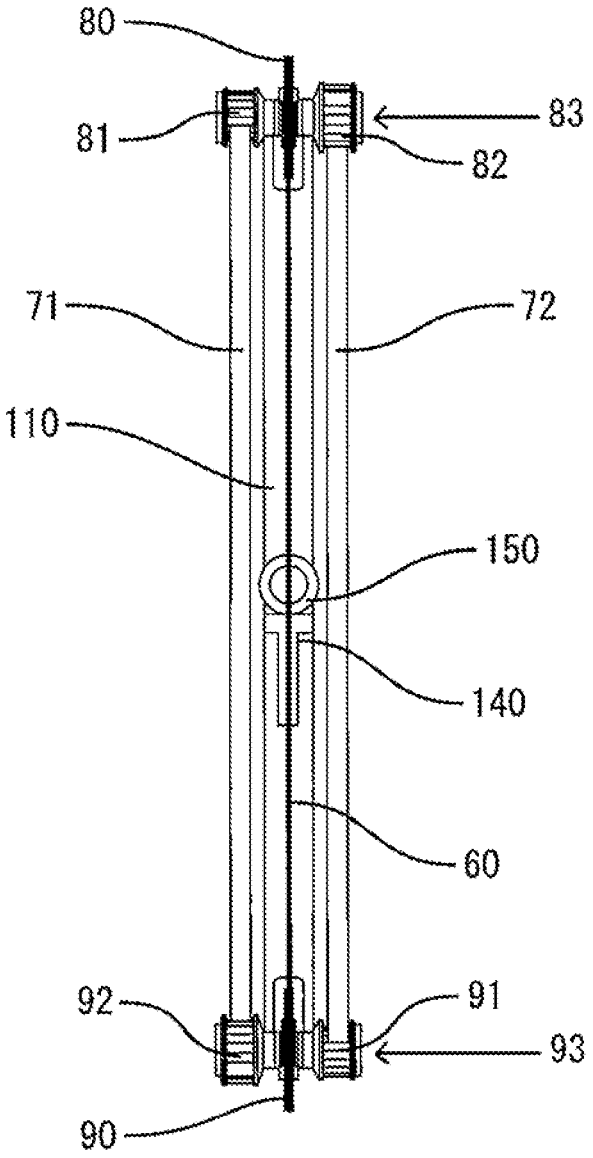
FIG. 9 is a rear view showing another embodiment of the frame.

FIG. 9 is a rear view showing a frame 110 as another embodiment of the frame. Although the frame 10 is arranged on an outside in the left-right direction of the first small diameter cam 81, the first large diameter cam 82, the second small diameter cam 91 and the second large diameter cam 92, the frame 110 is arranged on an inside of the cams at the position of the center in the left-right direction. Although the frame divided into two plates similar to the frame 10 can be arranged at the position of the center as shown in FIG. 9, one plate shaped (bar shaped) member is arranged on the center in the frame 110 of the present embodiment without dividing the frame into left and right. However, the frame 110 is divided into two in the left-right direction at the end portions in the vertical direction to avoid the interference with the first pulley 80 and the second pulley 90. Thus, the frame 110 is fixed to the first rotation shaft 83 and the second rotation shaft 93 at both left and right sides of the first pulley 80 and the second pulley 90. A grip 140 and a rest 150 are detachably attached to the frame 110. A hole through which the arrow is inserted is formed at the vertical center (position of the rest 150) of the frame 110 to penetrate through the frame 110 in the front-rear direction.

When the frame 110 is used, the structure of the frame can be simplified and the entire bow can be downsized compared to the case where the frame is divided into two in the left-right direction. In addition, since the frame is located at the center, the grip and the rest can be easily arranged. Note that the grip and the rest can be integrally formed with the frame.

Figure 10:
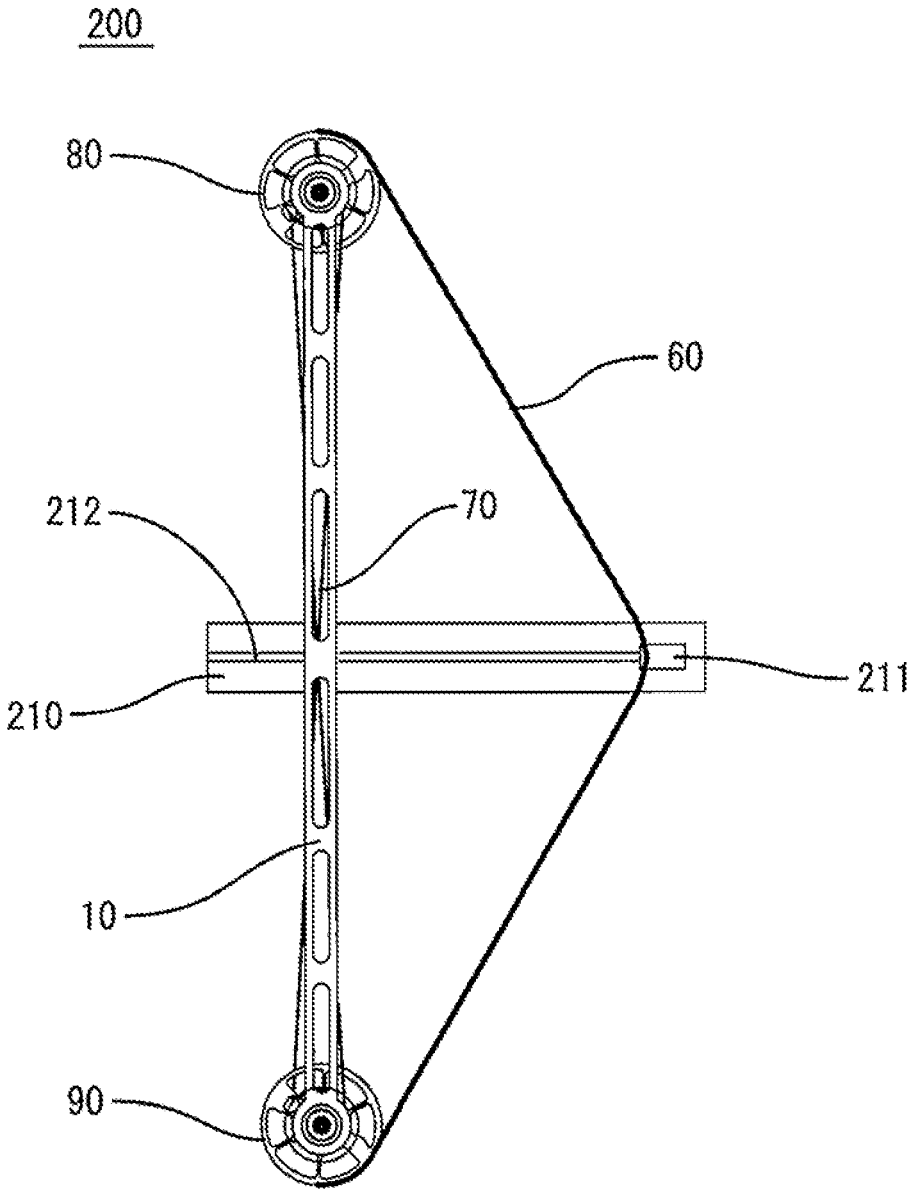
FIG. 10 is a plan view showing an example where the bow of the present invention is applied to a cross bow.

FIG. 10 is a plan view showing an example where the bow of the present invention is applied to a cross bow. A cross bow 200 can be formed by adding a base 210 on which the arrow is placed to the above described configurations of the frame 10, the string 60, the cable 70, the first pulley 80 (including the first small diameter cam 81, the first large diameter cam 82) and the second pulley 90 (including the second small diameter cam 91, the second large diameter cam 92). The base 210 is arranged so that the longitudinal direction of the base 210 is orthogonal to the longitudinal direction of the frame 10. The base 210 is fixed to the frame 10. The base 210 includes a string receiving member 211 to which the string 60 is fixed in a state of being pulled and a guide groove 212 for guiding the direction of the arrow. Although not illustrated, the cross bow 200 also includes the configuration provided with a normal cross bow such as a trigger for releasing the string 60 from the string receiving member 211. As shown in FIG. 10, the string 60 is attached to the string receiving member 211. In this state, the arrow is arranged on the guide groove 212 and the trigger is pulled. Thus, the string 60 is released and the arrow is shot frontward.

As illustrated as the cross bow 200, the elastic force for shooting the arrow can be accumulated when at least the frame 10, the string 60, the cable 70, the first pulley 80 and the second pulley 90 are provided in the present invention. In the present invention, the above described structure is referred to as an energy accumulating body. The energy accumulating body of the present invention can be applied to the type of the cross bow in addition to the types of the compound bow and the recurved bow. In the present invention, large force is not required for pulling the string 60. Thus, the preparation of the shooting is easier compared to the conventional cross bow.

Figure 11:
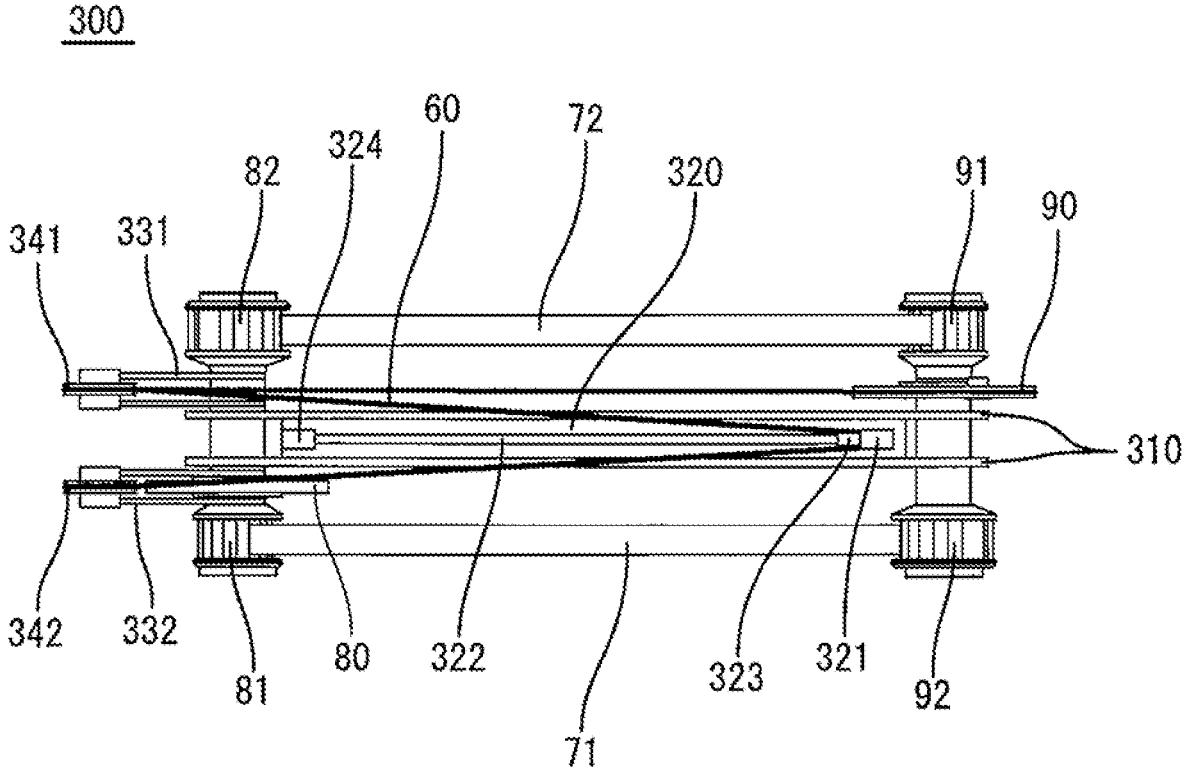
FIG. 11 is a plan view showing another embodiment of the frame and an example where the flame is applied to the cross bow.

FIG. 11 is a plan view showing an example where a frame 310 is applied to the cross bow as another embodiment of the frame. A cross bow 300 is formed by a frame 310, a base 320, a string 60, a cable 70, a first pulley 80 (including first small diameter cam 81, first large diameter cam 82), a second pulley 90 (second small diameter cam 91, second large diameter cam 92), auxiliary arms 331, 332 and auxiliary pulleys 341, 342. In the cross bow 300, the longitudinal direction of the frame 310 is arranged in parallel with the longitudinal direction of the base 320. Namely, different from the cross bow 200, the frame 310, the cable 70 and the like are arranged in parallel with the shooting direction of the arrow. Similar to the frame 10, the frame 310 is formed by a plate member arranged on the left and right. In the frame 310, similar to the frame 110, the frame 310 is arranged on an inside of the first small diameter cam 81, the first large diameter cam 82, the second small diameter cam 91 and the second large diameter cam 92. Although the pulleys around which the string 60 is wound are arranged on the same plane in the previous embodiments, the first pulley 80 and the auxiliary pulley 341 are arranged at the position displaced at a predetermined distance in the left-right direction with respect to the second pulley 90 and the auxiliary pulley 342 in the present embodiment.

The base 320 is arranged between the left and right plate members of the frame 310 and fixed to the frame 310. The base 320 includes a string receiving member 321 to which the string 60 is fixed in a state of being pulled, a guide groove 322 for guiding the direction of the arrow, a slider 323 configured to be moved in the front-rear direction together with the arrow along the guide groove 322, and a stopper 324 for restricting the motion of the slider 323 in the front-rear direction at a predetermined position. Although not illustrated, the cross bow 300 also includes the configuration provided with a normal cross bow such as a trigger for releasing the string 60 from the string receiving member 321. One end of the auxiliary arms 331, 332 is fixed coaxially with the first pulley 80 and the other end of the auxiliary arms 331, 332 is extended frontward and upward from the first pulley 80. The auxiliary pulleys 341, 342 are rotatably arranged respectively on the other end of the auxiliary arms 331, 332. The auxiliary pulley 341 and the auxiliary pulley 342 are arranged at the same position in the front-rear direction and the vertical direction. The slider 323 is fixed to the string 60 wound around the first pulley 80, the second pulley 90, the auxiliary pulley 341 and the auxiliary pulley 342. When the slider 323 is pulled rearward along the guide groove 322, the string 60 is pulled rearward. In this state, the slider 323 is attached to the string receiving member 321. Furthermore, when the arrow is arranged along the guide groove 322 and the trigger is pulled, the slider 323 is released from the string receiving member 321 and the slider 323 is moved frontward by the string 60. Consequently, the arrow is shot frontward. When the slider 323 collides with the stopper 324 arranged on the end portion of the front part of the guide groove 322, the frontward motion of the slider 323 is stopped at the position of the stopper 324. Consequently, the string 60 is prevented from jumping out frontward.

Figure 12:
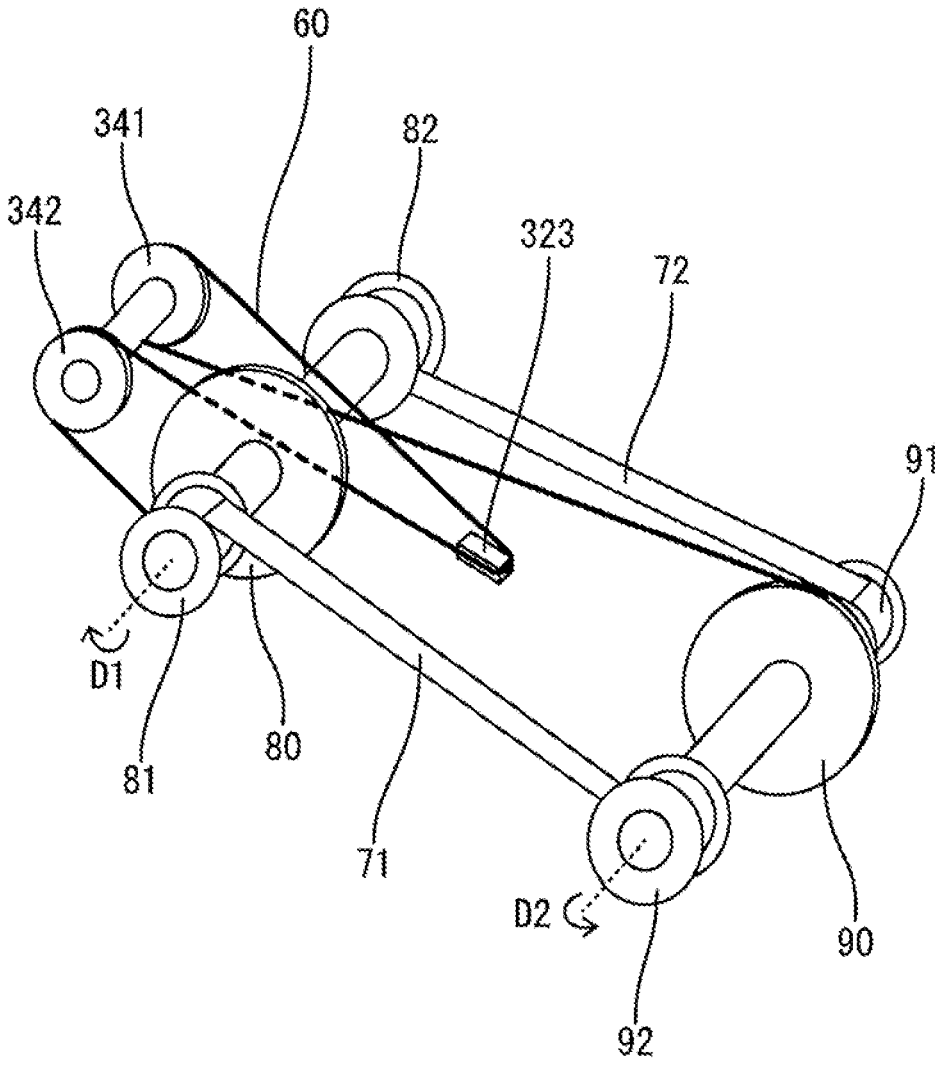
FIG. 12 is a perspective view showing an arrangement of a string of the cross bow of FIG. 11.

FIG. 12 is a perspective view showing an arrangement of the string 60 of the cross bow 300. For intelligibly illustrating the arrangement of the string 60, the frame 310 and the base 320 are omitted in FIG. 12. In addition, the broken lines are the portions hidden behind the other members. One end of the string 60 fixed to the upper part of the second pulley 90 is extended frontward, wound around the auxiliary pulley 341 from the bottom to the top via the front, and extended rearward toward the slider 323. The string 60 turned frontward at the position of the slider 323 is extended frontward again, wound around the auxiliary pulley 342 from the top to the bottom via the front, and fixed to the lower part of the first pulley 80. Consequently, when the slider 323 is pulled rearward, the first pulley 80 (first small diameter cam 81, first large diameter cam 82) is rotated in the first direction D1 and the second pulley 90 (second small diameter cam 91, second large diameter cam 92) is rotated in the second direction D2. Accordingly, the cross bow 300 functions similar to the bow 1 and the cross bow 200.

As illustrated as the cross bow 300, the auxiliary pulleys 341, 342 and the like are provided and the first pulley 80 and the second pulley 90 are arranged so as to be displaced in the left-right direction in the present invention. Thus, the elastic force can be accumulated by pulling the string 60 along the longitudinal direction of the frame. Consequently, the shape of the entire bow can be downsized compared to the structure where the string 60 is pulled along the direction orthogonal to the frame.

As explained above, the present invention has the structure of shooting the arrow by accumulating the elastic force in the string 60 using the energy accumulating body including at least the frame 10, the string 60, the cable 70, the first pulley 80 and the second pulley 90. Thus, large force is not required for pulling the string 60 rearward and the elastic force can be accumulated constantly anytime. In addition, since the cable 70 is linearly arranged, the frame 10 can be downsized. In addition, the first arm 20, the second arm 30, the grip 40, the rest 50 and the like can be detachably combined with the above described energy accumulating body. Thus, the shape of the bow can be easily customized according to the preference of the shooter. Since it is not required to pull the string 60 and the cable 70 strongly, the components can be carried in a state of being detached and the components can be assembled without using special tools at a place where the bow is used. Furthermore, there are various possibilities of application. For example, the cross bow is formed by combining the bases 210, 320 and the like.

In the above described embodiments, the structure of arranging the arms at the upper and lower parts of the frame is mainly explained. However, the structure of the bow is not limited to the above described structure. The structure of adding only one arm, the structure of three or more arms, and the structure not provided with the arms shown in the embodiment of the cross bow are included in the present invention.

In the above described embodiments, the upper end portion of the string 60 is fixed to the first pulley 80 and the lower end portion of the string 60 is fixed to the second pulley 90. However, it is not necessary to fix the string 60 to each of the pulleys at the end portion of the string strictly. As long as the string 60 is tensioned between the first pulley 80 and the second pulley 90, the position of fixing the string 60 to each of the pulleys is not particularly limited. The same applies to the cable 70.

In the above described embodiments, the structure of arranging the pulleys between the small diameter cam and the large diameter cam is explained. However, the positional relation of the pulley with respect to the small diameter cam and the large diameter cam is not limited to the above described structure. As long as the small diameter cam, the large diameter cam and the pulley are interlockingly rotated, it is possible to arrange the small diameter cam, the large diameter cam and the pulley in this order, for example.

In the above described embodiments, the structure of fixing the lower plate 31L (32L) to the frame 10 and move the upper plate 31U (32U) in the vertical direction is explained. However, it is also possible to fix the upper plate 31U (32U) to the frame and move the lower plate 31L (32L) in the vertical direction.

In the above described embodiments, the explanation is made for the configurations minimally required for explaining the present invention. However, the configurations attached to the normal bow can be added to the bow of the present invention. For example, it is possible to add a stabilizer for absorbing a reaction, a sight for aligning the sight and the like.

In the above described embodiments, the energy accumulating body of the present invention is applied to the bow.

However, it is also possible to accumulate the elastic force in the cable as an energy and use the energy for the operations of the machines other than the bow.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

DESCRIPTION OF THE REFERENCE NUMERALS

1 . . . bow, 10, 110, . . . frame, 11 . . . left plate, projection, 12 . . . right plate, 11A, 12A . . . notch, 11B,12B . . . projection, 13 . . . connection shaft, 14 . . . movable shaft, 15 . . . left movable plate, 16 . . . right movable plate, 15A, 16A . . . notch, 17 . . . bolt, 20 . . . first arm, 23 . . . third rotation shaft, 25 . . . third pulley, 30 . . . second arm, 31 . . . left plate, 32 . . . right plate, 31A, 32A . . . notch, 31L, 32L . . . lower plate, 31U, 32U . . . upper plate, 33 . . . fourth rotation shaft, 35 . . . fourth pulley, 40, 140 . . . grip, 41, 42 . . . connection plate, 50, 150 . . . rest, 51 . . . connection plate, 60 . . . string, 70 . . . cable, 71 . . . first cable, 72 . . . second cable, 80 . . . first pulley, 81 . . . first small diameter cam, 82 . . . first large diameter cam, 81A, 82A . . . bobbin, 83 . . . first rotation shaft, 90 . . . second pulley, 91 . . . second small diameter cam, 92 . . . second large diameter cam, 91A, 92A . . . bobbin, 93 . . . second rotation shaft, 200, 300 . . . cross bow, 210 . . . base, 211 . . . string receiving member, 212 . . . guide groove, 320 . . . base, 321 . . . string receiving member, 322 . . . guide groove, 323 . . . slider, 324 . . . stopper, 331, 332 . . . auxiliary arm, 341, 342 . . . auxiliary pulley

What is claimed is:

1. A bow comprising:

a frame formed in a linear shape having a predetermined length;

a first pulley arranged on a first position of the frame;

a second pulley arranged on a second position of the frame;

a first small diameter cam configured to be rotatable interlocked with the first pulley, the first small diameter cam being arranged on the first position;

a first large diameter cam configured to be rotatable interlocked with the first pulley, the first large diameter cam being arranged on the first position;

a second small diameter cam configured to be rotatable interlocked with the second pulley, the second small diameter cam being arranged on the second position;

a second large diameter cam configured to be rotatable interlocked with the second pulley, the second large diameter cam being arranged on the second position;

a string fixed to the first pulley and the second pulley, the first pulley and the second pulley being configured to be rotated when the string is pulled;

a first cable arranged in a linear shape between the first small diameter cam and the second large diameter cam, the first cable being configured to be elastically deformed by being wound around the second large diameter cam when the string is pulled; and a second cable arranged in a linear shape between the second small diameter cam and the first large diameter cam, the second cable being configured to be elastically deformed by being wound around the first large diameter cam when the string is pulled, wherein the first cable is linearly arranged on a line connecting the first small diameter cam and the second large diameter cam, the second cable is linearly arranged on a line connecting the second small diameter cam and the first large diameter cam, and the frame is linearly formed along a line connecting the first positon and the second position.

2. The bow according to claim 1, wherein the first pulley and the second pulley are configured to be movable along a direction connecting the first position on which the first pulley is arranged and the second position on which the second pulley is arranged so that a distance between the first position and the second position is expanded and contracted.

3. The bow according to claim 2, wherein the first pulley and the second pulley are inserted into notches formed along a longitudinal direction of the frame so that the first pulley and the second pulley can be moved along the longitudinal direction, and the first pulley and the second pulley are configured to be fixable to the frame at an arbitrary position in a moving area of the first pulley and the second pulley with respect to the frame.

4. The bow according to claim 1, further comprising:

a first arm fixed to the frame;

a second arm fixed to the frame;

a third pulley arranged on the first arm; and a fourth pulley arranged on the second arm, wherein the string is wound around the third pulley and the fourth pulley.

5. The bow according to claim 4, wherein the first arm is attachable to and detachable from the frame, and the second arm is attachable to and detachable from the frame.

6. The bow according to claim 5, wherein the first arm is configured to be foldable around a first rotation shaft of the third pulley in a state that the first arm is detached from the frame, and the second arm is configured to be foldable around a second rotation shaft of the fourth pulley in a state that the second arm is detached from the frame.

7. The bow according to claim 4, wherein a first inclination angle of the first arm is changeable with respect to a line connecting the first position and the second position of the frame, and a second inclination angle of the second arm is changeable with respect to the line connecting the first position and the second position of the frame.

8. The bow according to claim 1, further comprising:

a grip attachable to and detachable from the frame.

9. The bow according to claim 1, further comprising:

a base arranged so that a longitudinal direction of the base is orthogonal to a longitudinal direction of the frame;

a string receiving member to which the string is fixed in a state of being pulled, the string receiving member being provided on the base; and a trigger for releasing the string from the string receiving member.

10. The bow according to claim 1, further comprising:

a base arranged so that a longitudinal direction of the base is in parallel with a longitudinal direction of the frame;

a string receiving member to which the string is fixed in a state of being pulled, the string receiving member being provided on the base; and a trigger for releasing the string from the string receiving member.

* * * * *